US005921190A

United States Patent [19]

Wood

[11] Patent Number: 5,921,190

[45] Date of Patent: Jul. 13, 1999

[54] MODULAR DISPLAY SYSTEM

[75] Inventor: Graham Robert Wood, Glencoe, Ill.

[73] Assignee: Stamford Investments, Inc., Prospect Heights, Ill.

[21] Appl. No.: 08/784,057

[22] Filed: Jan. 17, 1997

[51] Int. Cl.[6] ..... A47B 9/00

[52] U.S. Cl. ..... 108/108; 108/106

[58] Field of Search ..... 108/108, 106, 108/107, 110, 152, 153.1, 60; 211/187, 190; 52/36.5, 36.4, 36.1, 775, 762, 79.1; 312/265.1, 265.2, 265.3, 265.4, 265.5, 265.6

[56] References Cited

U.S. PATENT DOCUMENTS

| | | | |
|---|---|---|---|
| 2,693,884 | 11/1954 | Gurries . | |
| 3,007,708 | 11/1961 | Ochs | 108/107 X |
| 3,057,483 | 10/1962 | Derman . | |
| 3,148,638 | 9/1964 | Shelor | 108/108 |
| 3,346,124 | 10/1967 | Sobel . | |
| 3,450,270 | 6/1969 | Brown . | |
| 3,640,389 | 2/1972 | Snyder | 108/108 X |
| 3,784,025 | 1/1974 | Dumit . | |
| 3,871,144 | 3/1975 | Rudin | 52/36.5 |
| 4,102,089 | 7/1978 | Paisley . | |
| 4,312,086 | 1/1982 | Bianco | 108/108 X |
| 4,697,712 | 10/1987 | Valiulis | 108/107 X |
| 5,163,568 | 11/1992 | Laurendeau et al. . | |
| 5,255,803 | 10/1993 | Pavone et al. . | |
| 5,477,971 | 12/1995 | Howard . | |
| 5,483,779 | 1/1996 | Crawford et al. | 52/36.1 X |
| 5,566,844 | 10/1996 | Bernardin . | |

*Primary Examiner*—Jose V. Chen
*Attorney, Agent, or Firm*—Welsh & Katz, Ltd.

[57] ABSTRACT

A modular display system includes at least two spaced apart, parallel, vertically oriented upright supports, each having an upper end and a lower end, and at least two spaced apart, parallel, horizontally oriented spanning supports extending between and connecting the upright supports and forming a frame. The upright supports and the spanning supports defining a plane. At least one of the upright supports and the spanning supports defines a plurality of spaced apart, corresponding openings formed therein lying in the plane. A partition member is positioned in the frame, within the plane, between the upright supports and the spanning supports. The partition member can include an interchangeable panel element for changing the color and display media and the like. The partition member has a mounting portion including a plurality projecting elements extending therefrom for engaging the openings in one of the upright supports and the spanning supports. The partition member is positioned between the supports having at least a portion of the projecting elements exposed. At least one attachment element is mountable on the display system, attached to the exposed projection portions, and is mountable so as to span the partition member.

11 Claims, 5 Drawing Sheets

MODULAR DISPLAY SYSTEM

FIELD OF THE INVENTION

This invention relates to a modular display system. More particularly, the invention relates to a modular display system including partitions with readily engageable shelves, hangers, media and display boards and the like.

BACKGROUND OF THE INVENTION

Display systems are well known in the art. Such systems can be used, for example, for retail display of various types of items. Consumers will likely recognize such systems which can include shelves for displaying merchandise, hangars from which items may be displayed, and media boards for merchandise display and for advertising materials. Such display systems can also be used for office arrangements, and can include writing surfaces, shelving and the like.

One known type of display or partition system includes a pair of standards or upright posts between which a partition is mounted. A plate-like element is positioned and mounted between the partition and each post. The plate element is mounted between the post and the partition by fastening elements resembling bolts. The plate-like element includes a plurality of pairs of square projections extending therefrom. Shelf brackets having downwardly facing hooks can be mounted to the partition by engaging the hooks with the square projections.

In another known type of shelving support structure, a pair of elongated metal sheets are positioned in parallel, spaced from one another. The sheets are connected by two metal rods that are bent in a serpentine manner to form a series of square wave configurations that extend along the length of the sheets. Shelf support brackets can be inserted between the metal sheets and engage with the bent rods.

Still other display systems are known that use a gondola type base unit (e.g., expanded base unit) and an upright supporting structure. The display can be erected adjacent to a like display, and can include lugs extending between display units. Shelves can be hung from the side-by-side display units from the lugs extending therebetween.

Inasmuch as known display systems may function well for displaying merchandise, they suffer from a number of drawback. First, such known systems are generally not flexible. That is, they can be erected in only a limited number of configurations and require some type of intermediate interconnecting member. In addition, whereas portions of such known systems can carry a particular color scheme or environment, for example, as part of a partition wall, because of the way in which such known display systems are manufactured, the color scheme is permanent and cannot be changed.

There has also been a trend to use such display systems in temporary settings, such as art and crafts shows, and in remote kiosks, such as those often seen free standing in shopping malls. Use of such display systems in temporary and remote locations requires that the systems be flexible, that is, erectable in a wide variety of configurations, and readily assembled and disassembled. Known display systems do not afford flexibilty and ready erectability, with aesthetic appeal.

Accordingly, there continues to be a need for a flexible and readily erectable display system, that permits a wide variety of display configurations, in combination with quick assembly and disassembly. Preferably, such a display system also affords aesthetic appeal by providing interchangeable color schemes and other visually appealing effects and appurtenances.

SUMMARY OF THE INVENTION

A modular display system provides ease of use, assembly and disassembly. The display system includes at least two spaced apart, parallel, vertically oriented upright supports, each having an upper end and a lower end and at least two spaced apart, parallel, horizontally oriented spanning supports extending between and connecting the upright supports, forming a frame. The upright supports and the spanning supports define a plane.

At least one of the upright supports and the spanning supports defines a plurality of spaced apart, corresponding openings formed therein lying in the plane. The display system includes a partition member positioned within the frame, in the plane defined by, and between, the upright supports and the spanning supports. The partition member has a mounting portion including a plurality projecting elements extending therefrom for engaging the openings in one of the upright supports and the spanning supports.

The partition member is positioned between the supports having at least a portion of the projecting elements exposed. The display includes at least one attachment clement which is mountable to the display, attached to the exposed projection portions. When mounted to the display system, the attachment element is mounted so as to span the partition member. The attachment elements include, for example, shelves, hangers and boards.

In a preferred embodiment, the display includes a plurality of partition member configurations such as an open screen or mesh-like partition, and a wall or like member having a solid central portion. The partition member is mounted to the frame so as to lie in the plane defined by the supports. In a most preferred configuration, the display system wall-like partition member includes a removable panel which permits the interchangeability of such panels for, for example, changing the display system color scheme.

A plurality of partition members can be positioned between a single pair of upright supports. When configured in this manner, the projections extending from the upper and lower portions of the partition are positioned in and engaged with the openings in the upper and lower horizontal spanning supports. The projections extending from the sides of the partition may include an end termination element that permits use of the projections for mounting attachment elements thereto, and precludes the attachment elements slipping therefrom.

Other features and advantages of the present invention will be apparent from the following detailed description, the accompanying drawings, and the appended claims.

DETAILED DESCRIPTION OF THE PREFERRED EMBODIMENTS

Figure 1:
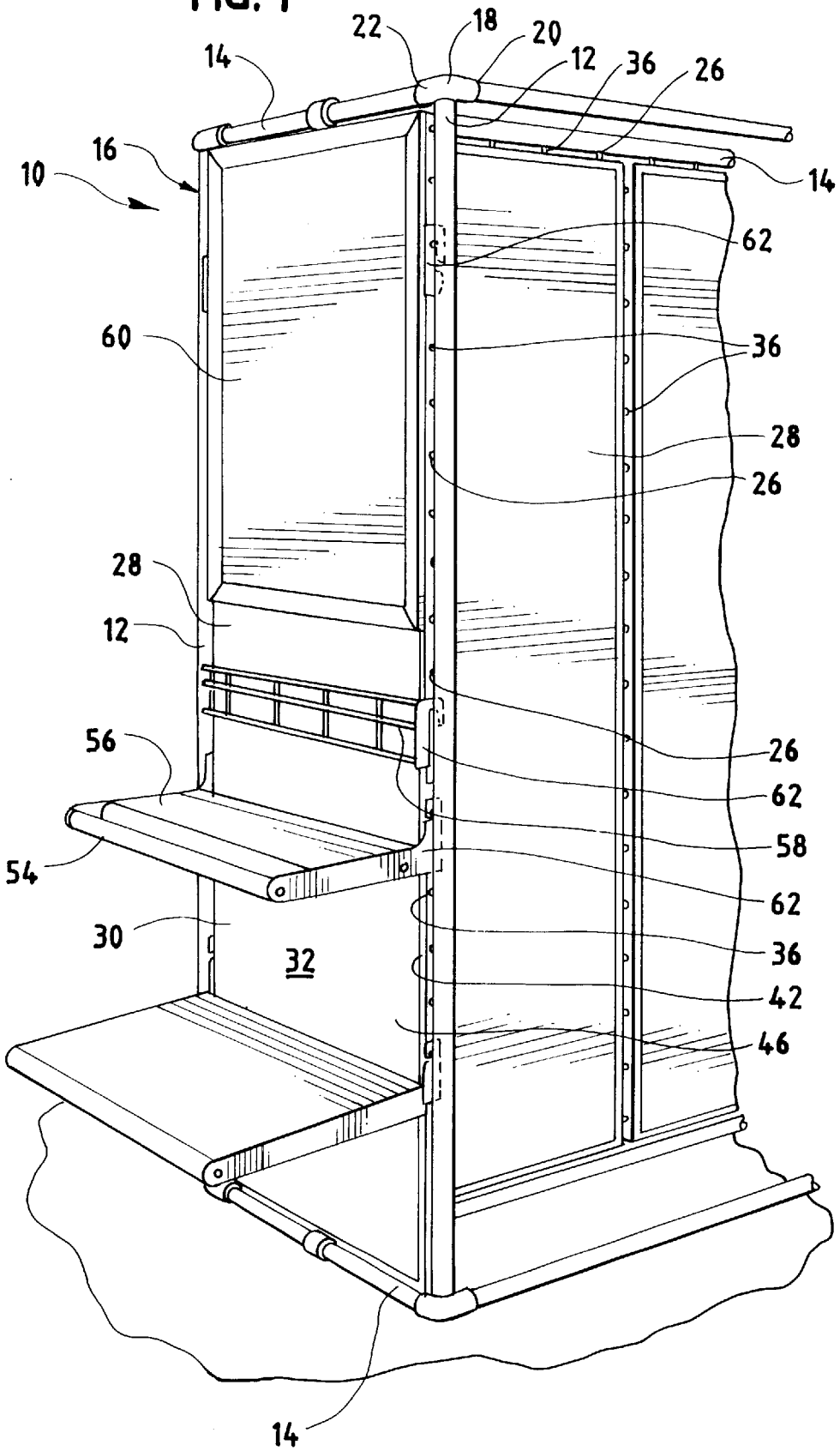
FIG. 1 is a perspective view of a modular display system embodying the principles of the present invention, illustrating a partition member with a pair of shelving attachments, a hanging attachment and a media board attachment mounted thereto, and illustrated with other partition members attached thereto.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

Figure 6:
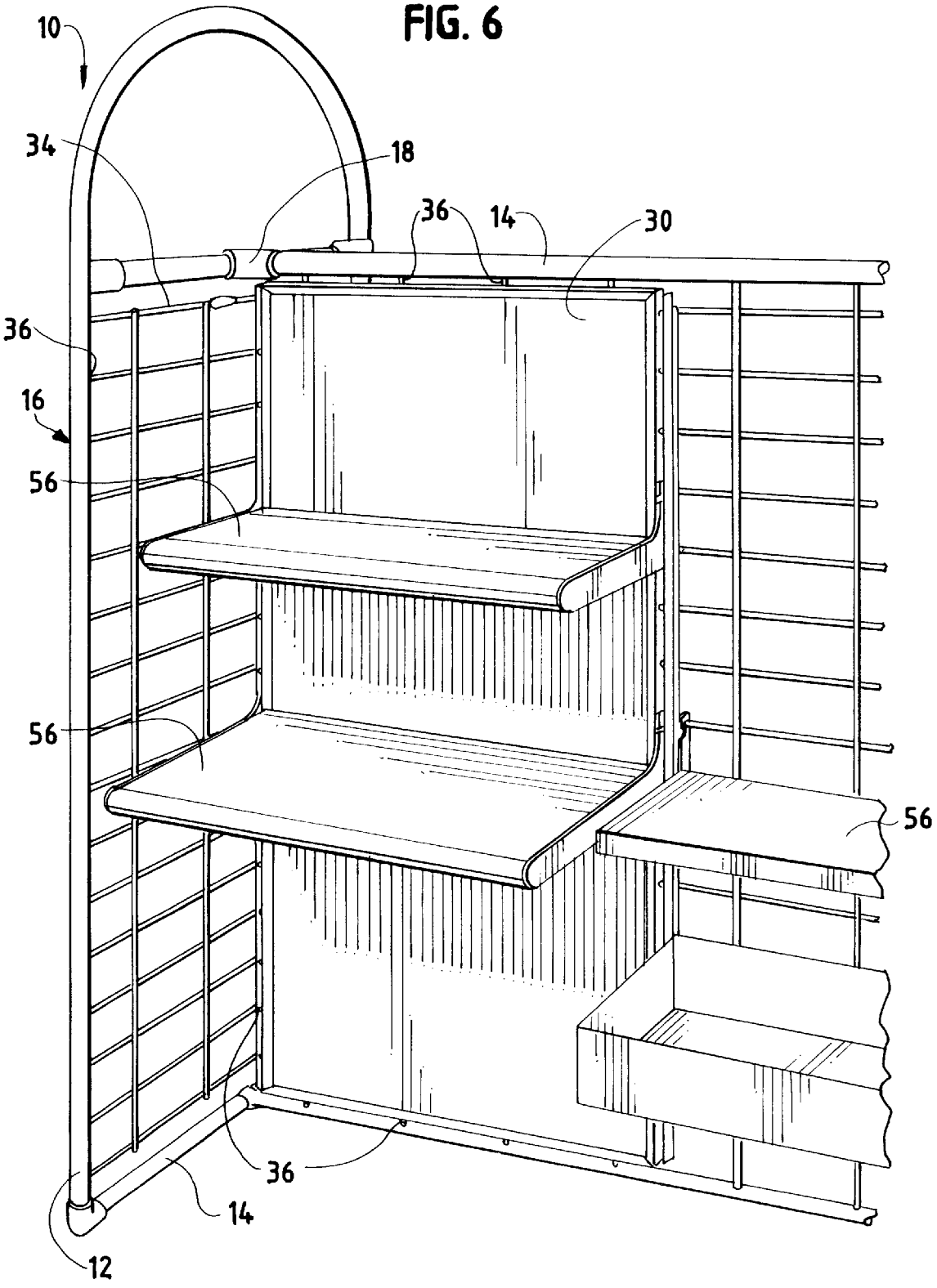
FIG. 6 is a perspective view of one of the many configurations of the display system, illustrated with mesh members, and a partition member having various display attachments mounted thereto.

Referring now to the figures and more particularly to FIGS. 1 and 6, there are shown two differing configurations of modular display systems 10 embodying the principles of the present invention. The display system 10 is configured to be readily assembled and disassembled, and to permit maximum flexibility in design and configuration.

The system 10 includes a plurality of vertically oriented, upright supports 12, such as the exemplary support posts, and a plurality of horizontally oriented, spanning supports 14. In a basic form, the system 10 includes a rectangular frame 16 having a pair of upright supports 12 and a pair of spanning supports 14. The vertical supports 12 are parallel to one another and the horizontal supports 14 are parallel to one another. When assembled, the supports 12, 14 define a plane P.

Figure 8:
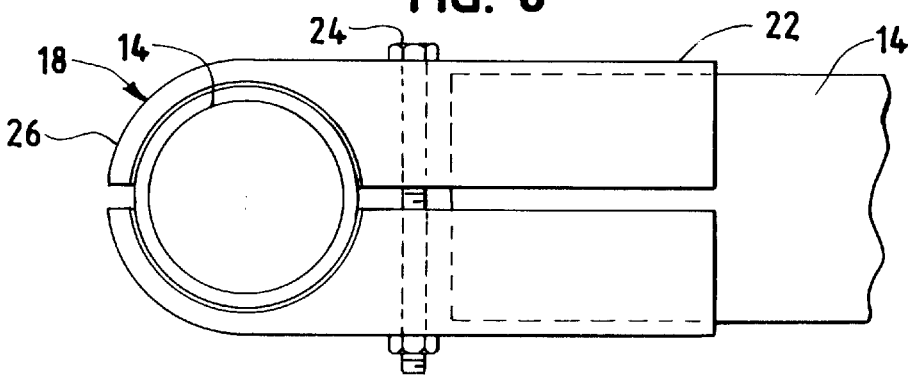
FIG. 8 illustrates an exemplary compression clamp used to connect the supports to one another.

The supports 12, 14 are connected to their adjacent supports 12, 14 by a compression type clamp or fitting 18, such as the exemplary clamp illustrated in FIG. 8. The compression clamp 18 used is of relatively simple construction and ease of use. Preferably, the clamp 18 used includes spaced ends 20, 22 adapted to receive two or more supports 12, 14, and a single bolt 24 for tightening the clamp 18. The single bolt 24 arrangement permits quick assembly and disassembly of the display system frame 16.

The supports 12, 14 illustrated have a circular cross-section. However, it is anticipated that members having other cross-sectional shapes, e.g., square tubes, can also be used in connection with the display system frame 16.

The supports 12, 14 include a plurality of openings 26 therein. Preferably, the openings 26 are equally spaced from one another along a common longitudinal line L traversing the support. In a preferred embodiment, the openings 26 are spaced about 3 inches from one another. The openings 26 in the supports 12, 14 correspond with like openings 26 in the opposing support 12, 14. That is, corresponding openings 26 in opposing vertical supports 12 fall in a horizontal plane that is parallel to the horizontal supports 14. Likewise, corresponding openings in opposing horizontal supports 14 fall in a vertical plane that is parallel to the vertical supports 12.

The display system 10 includes a partition member 28 mounted to the supports 12, 14, central of the frame 16. The partition member 28 can include a wall 30 or like member having a solid central portion 32. Alternately, the partition member 28 can include a screen or mesh-like open member 34. The partition member 28 lies in the plane P defined by the supports 12, 14 and includes a plurality of projecting elements 36 extending therefrom. In a preferred embodiment, the projections 36 are cylindrical dowel or peg-like members extending transversely from the partition 28. The projecting elements 36 are configured to insert into and engage the openings 26 in the supports 12 14.

Figure 4:
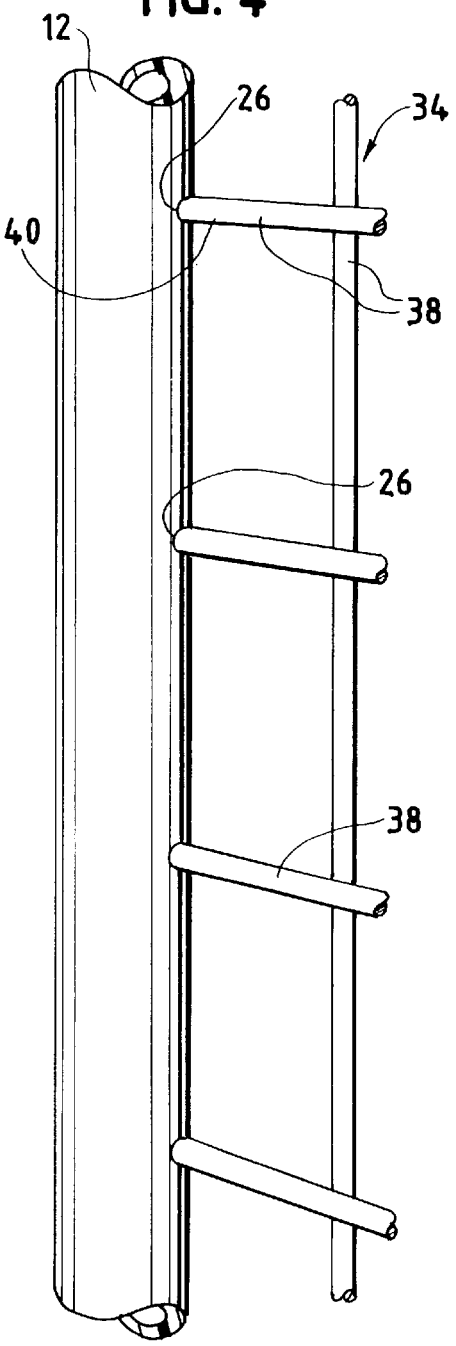
FIG. 4 is a partial perspective view of the display system illustrating a rigid mesh partition member mounted to the upright support post.
Figure 7:
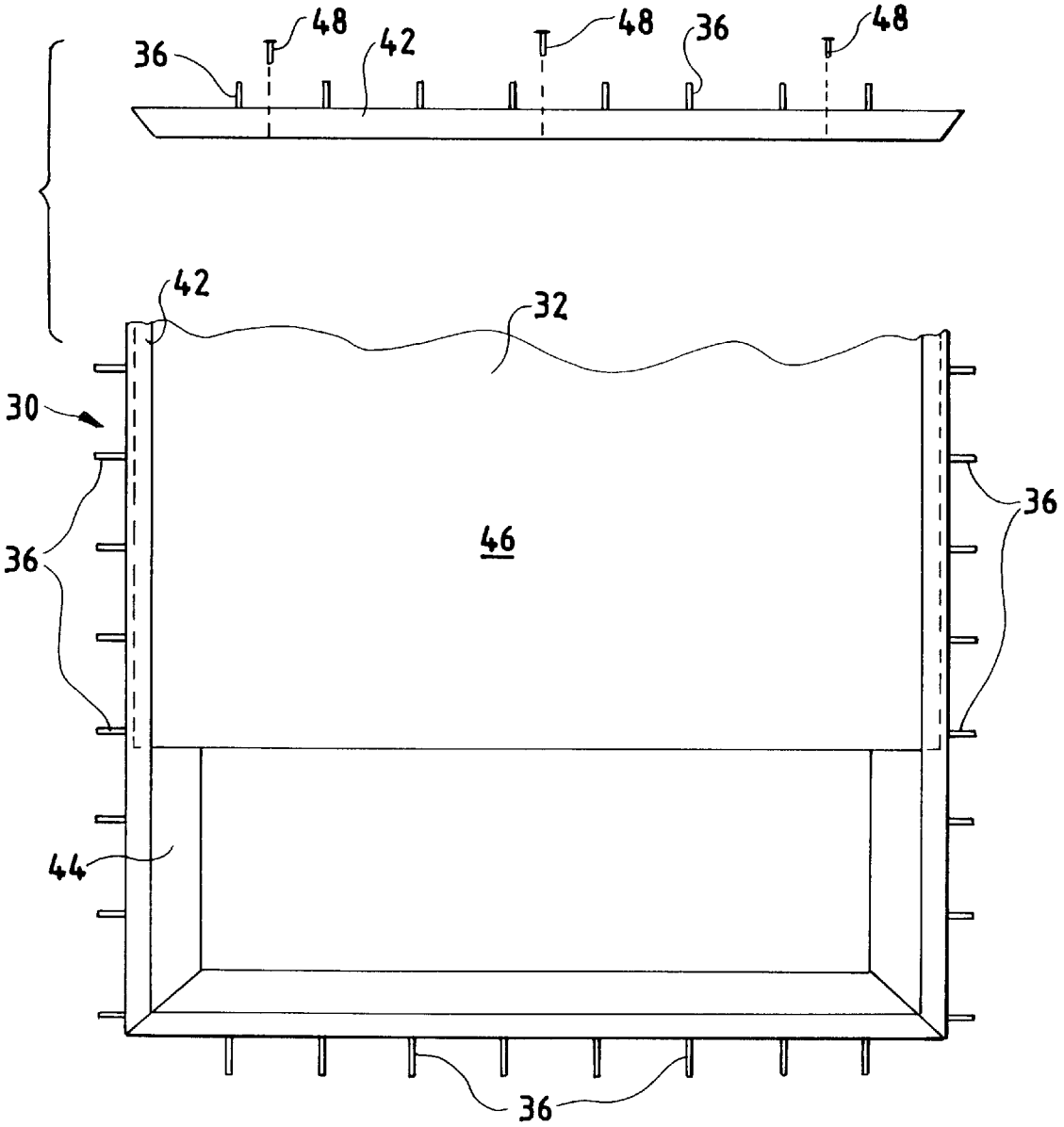
FIG. 7 is a partial exploded view of a wall-like partition member of the present display system, shown with the replaceable panel element partially removed.

As illustrated in FIG. 4, the mesh-like partition member 34 can be formed of a series of connected rods 38, the ends 40 of which can form the projecting elements 36. As illustrated in FIG. 7, the wall-like partition member 30 can include a peripheral frame 42 having the projecting elements 36 extending transversely therefrom.

In a preferred embodiment, the wall 30 includes an inner core portion 44, such as a wooden frame, a peripheral frame 42 formed of, for example, aluminum, and a panel element 46. The panel element 46 may be formed of a relatively thin, rigid material, such as Formica® or a like laminate. Preferably, the peripheral frame 42 can be fully or partially removed from the wall-like partition member 30, and the panel element 46 can be replaced with other, like panel elements 46. The peripheral frame 42 can be affixed to the core 44 by fasteners, such as the exemplary threaded screws 48.

The replaceable panel element 46 arrangement greatly increases the flexibility of the display system 10 by facilitating the interchangeability of panel elements 46. The panel elements 46 may be interchanged with like panel elements 46 to, for example, change the color scheme of the display system 10, or to add or remove advertising and display media and the like. Advantageously, the present interchangeable panel 46 configuration permits a greatly increased range of uses for the system 10, over known display arrangements. It will be recognized by those skilled in the art that the replaceable central panel element arrangement permits a wide variety of functions and uses not previously known, which arrangements and uses are within the scope of the present invention.

Figure 5:
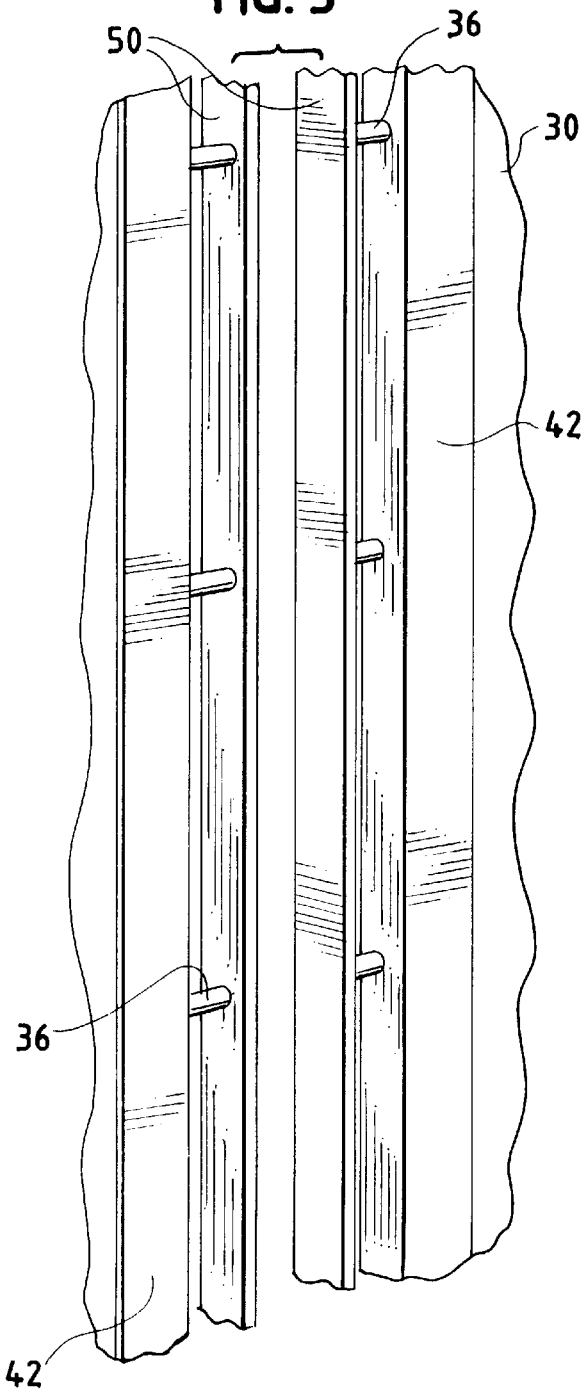
FIG. 5 is a partial perspective view of the display system, showing partition members and projections having termination elements integral therewith.

The partition member 28 can be formed having an end termination element 50 thereon, as illustrated in FIG. 5. The end termination element 50 extends along a side of the partition 28, transverse to and connecting the projecting elements 36. The end termination element 50 may be formed as a strip or bar, as illustrated, or in a variety of other shapes and configurations.

Figure 2:
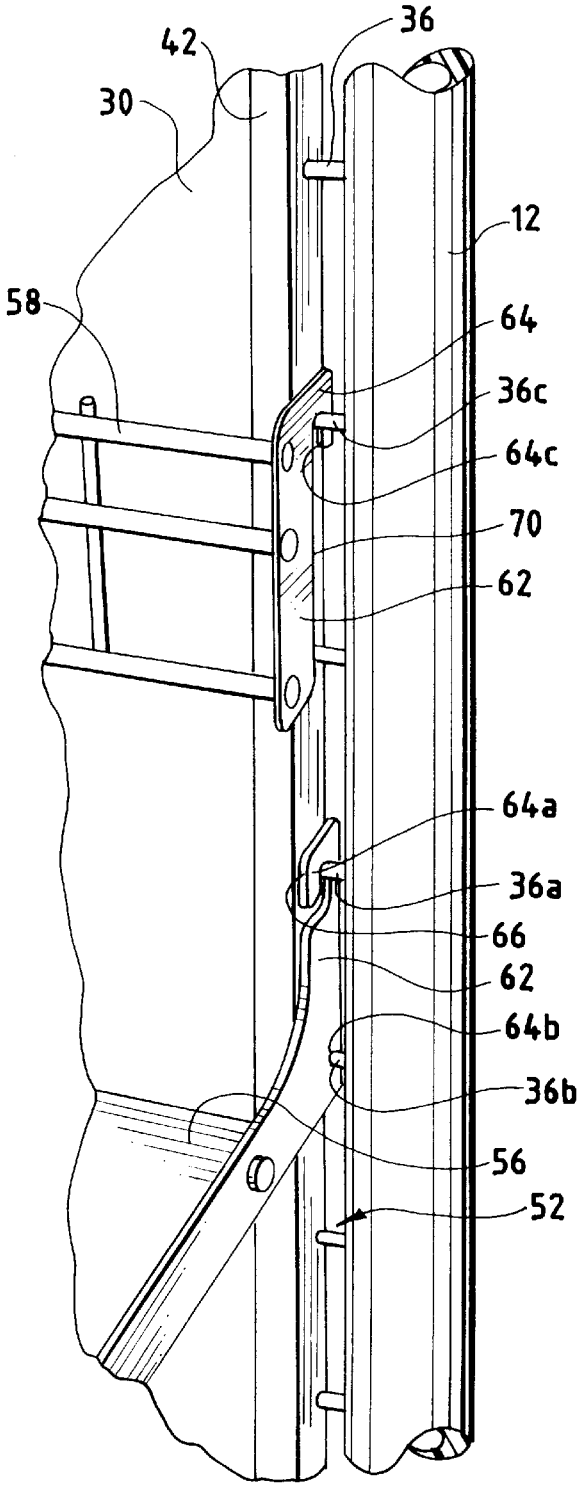
FIG. 2 is a partial front perspective view of the display system of FIG. 1, illustrating the mounting arrangement for mounting the partition members to an upright support post, and showing shelf and hanger attachment members mounted thereto.

When the partition member 28 is positioned within the support frame 16, at least a portion of the projecting elements 36 are exposed, as indicated by the arrow at 52. For example, as illustrated in FIG. 2, when a wall-like member 30 is positioned in the support frame 16, the wall peripheral frame member 42 is positioned such that it does not abut the adjacent support member 14, but rather is spaced therefrom. This configuration permits access to the projections 36 from both the front and rear of the display frame 16.

Figure 3:
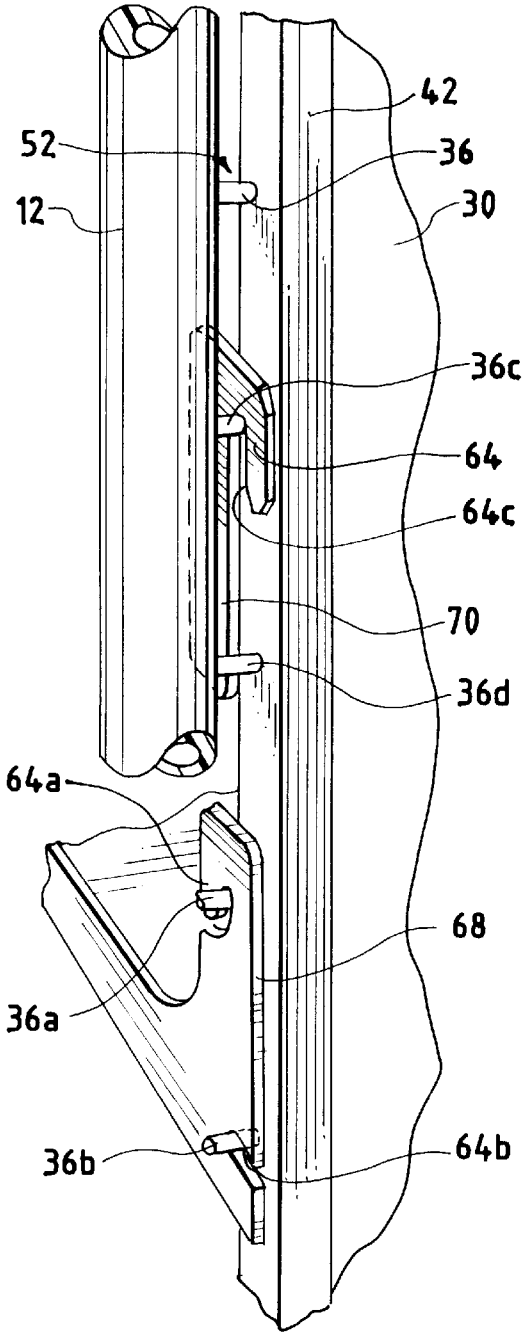
FIG. 3 is a partial rear perspective view of the arrangement of FIG. 2.

The display system 10 also includes an attachment element 54. Attachment elements 54 can include one or more of the exemplary shelves 56, hanger 58 and media board 60. As illustrated in FIGS. 2 and 3, the attachment elements 54 each include a pair of mounting members 62 that are each configured to engage the projections 36 one either side of an associated partition member 28. For example, when a shelf 56 is attached to the display system 10 over a wall-like partition member 30, the mounting members 62 engage the projections 36 that are exposed on either side of the partition 30. In this manner, the attachment, in the present example the shelf 56, is firmly engaged with and mounted to the support frame 16 and the partition member 30 at the projections 36.

As shown in the figures, the mounting members 62 can be formed so as to have one or more hook-like elements 64. The shelf 56 mounting member 62 includes a first, angled, upper hook-like slot 64*a* extending rearwardly and upwardly from a front face 66 of the mounting member 62, and a second, lower, slot 64*b* extending forwardly from a rear face 68 of the mounting member 62. The upper and lower slots 64*a*, 64*b* are engaged with corresponding upper and lower projections 36*a*, 36*b* at the desired height of the shelf 56.

Alternately, a hanger 58 may be mounted to the display 10. Because the hanger 58 may be subject to a lower weight bearing load, and a lower static moment due to the smaller cantilever effect, the hanger 58 can include a single, upwardly extending slot 64*c* on each mounting member 62, which slot engages a single projection 36*c* on each side of the partition 28. A bracing portion 70 of the mounting member 62 is configured to abut a lower projection 36*d* to stabilize the hanger 58. Those skilled in the art will readily recognize other mounting member 62 configurations that can be used.

As illustrated in FIGS. 1 and 6, a plurality of partition members 28 can be positioned between a single pair of upright supports 12, without intermediate upright supports. To effect positioning the partition member 28 within the frame 16, the projections 36 that extend from the upper portion of the partition 28 are positioned in the openings 26 in the upper, horizontally oriented spanning support 14 and the projections 36 that extend from the lower portion of the partition 28 are positioned in the openings 26 in the lower, horizontally oriented spanning support 14. Engagement of the projections 36 in the upper and lower spanning supports 14 maintains the partition 28 in place and stabilizes the partition 28 within the frame 16.

When the display 10 is used in this manner, partition members 28 having end termination elements 50 can be used to provide a configuration for mounting attachment elements 54, such as shelves 56, hangers 58 and the like, from the display system 10. The end termination elements 50 permit mounting the attachments 54 thereto and prevent inadvertent slipping of the attachments 54 from the projections 36. This arrangement provides increased flexibility and a wide variety of additional design configurations for the display system 10.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A modular display system comprising:

at least two spaced apart, parallel, vertically oriented upright supports, each having an upper end and a lower end;

at least two spaced apart, parallel, horizontally oriented spanning supports extending between and connecting the upright supports, said upright supports and said spanning supports defining a plane, wherein at least one of the upright supports and the spanning supports defines a plurality of spaced apart, corresponding openings formed therein lying in said plane;

a partition member positioned in said plane between said upright supports and said spanning supports, said partition member having a mounting portion including a plurality of projecting elements having a substantially constant cross-section and terminating in a non-expanding end portion extending therefrom for engaging the openings in one of said upright supports and said spanning supports, said partition member being positioned between said supports having at least a portion of said projecting elements exposed; and at least one attachment element mountable to said exposed projection portions, and being mountable so as to span said partition member.

2. The modular display system in accordance with claim 1 wherein said partition member includes a removable panel.

3. The modular display system in accordance with claim 1 wherein said partition member includes an end termination element extending between at least some of said projecting elements.

4. The modular display system in accordance with claim 1 wherein said partition member mounting portion includes a frame and wherein said projecting elements extend from said frame.

5. The modular display system in accordance with claim 1 wherein said partition member includes a mesh portion.

6. The modular display system in accordance with claim 1 wherein said attachment element includes at least one of a shelf, a hanger and a media board.

7. The modular display system in accordance with claim 1 wherein said projecting elements have a cylindrical shape.

8. A modular display system comprising:

at least two spaced apart, parallel, vertically oriented upright supports, each having an upper end and a lower end;

at least two spaced apart, parallel, horizontally oriented spanning supports extending between and connecting the upright supports, said upright supports and said spanning supports defining a planar frame, wherein at least one of said upright supports and said spanning supports defines a plurality of spaced apart, corresponding, circular openings formed therein lying in said plane;

a partition member positioned in said frame between said upright supports and said spanning supports, said partition member having, a peripheral frame including a plurality of equally spaced projecting elements integral therewith and extending therefrom, said projecting elements having a cylindrical shape and a substantially constant cross-section terminating in a non-expanding end portion, and being capable of insertion into and engagement with said openings in one of said upright supports and said spanning supports, said partition member being positioned between said supports having at least a portion of said projecting elements exposed between said peripheral frame and said supports, said partition having an inner core portion and a removable panel secured between said core portion and said peripheral frame; and at least one attachment element mountable to said exposed projection portions, said attachment portion being mountable so as to span said partition member.

9. The modular display system in accordance with claim 8 including a rigid, mesh-like partition portion.

10. The modular display system in accordance with claim 8 wherein said peripheral frame is removably mounted to said partition.

11. The modular display system in accordance with claim 8 wherein said attachment element includes at least one of a shelf, a hanger and a media board.

* * * * *